US005658194A

United States Patent [19]

Micheletti

[11] Patent Number: 5,658,194

[45] Date of Patent: Aug. 19, 1997

[54] SUPER ABRASIVE GRINDING WHEELS

[75] Inventor: Patrick Micheletti, Saint-Denis, France

[73] Assignee: Norton S.A., La Courneuve Cedex, France

[21] Appl. No.: 549,819

[22] PCT Filed: Apr. 11, 1995

[86] PCT No.: PCT/FR95/00462

§ 371 Date: Jan. 23, 1996

§ 102(e) Date: Jan. 23, 1996

[87] PCT Pub. No.: WO95/27592

PCT Pub. Date: Oct. 19, 1995

[30] Foreign Application Priority Data

Apr. 12, 1994 [FR] France ..... 94 04302

[51] Int. Cl.[6] ..... B23F 21/03

[52] U.S. Cl. ..... 451/541; 451/540; 51/309; 51/293

[58] Field of Search ..... 451/540, 451; 51/309, 293, 295

[56] References Cited

U.S. PATENT DOCUMENTS

| | | | |
|---|---|---|---|
| 2,811,960 | 11/1957 | Fessel | 451/541 |
| 3,069,816 | 12/1962 | Pratt et al. | 451/541 |
| 3,183,632 | 5/1965 | Ferchland | 451/541 |
| 3,540,162 | 11/1970 | Blackmer et al. . | |
| 3,594,141 | 7/1971 | Houston et al. . | |
| 3,640,027 | 2/1972 | Weiss | 451/541 |
| 3,756,796 | 9/1973 | Miller | 451/541 |
| 3,919,811 | 11/1975 | Hedelin | 451/540 |
| 3,925,035 | 12/1975 | Keat . | |
| 4,042,347 | 8/1977 | Sioui . | |
| 4,184,854 | 1/1980 | Sioui et al. . | |
| 4,505,251 | 3/1985 | Stoll | 451/540 |
| 4,547,998 | 10/1985 | Kajiyama | 451/541 |
| 4,621,464 | 11/1986 | Kelly | 451/541 |
| 4,634,453 | 1/1987 | Hay et al. | 51/293 |
| 4,671,021 | 6/1987 | Takahashi et al. | 451/540 |
| 4,944,773 | 7/1990 | Rue et al. . | |
| 4,977,710 | 12/1990 | Une | 51/309 |
| 5,049,164 | 9/1991 | Horton et al. . | |
| 5,090,970 | 2/1992 | Rue et al. | 51/309 |
| 5,385,591 | 1/1995 | Ramanath et al. . | |
| 5,443,418 | 8/1995 | Frodin et al. . | |

FOREIGN PATENT DOCUMENTS

| | | | |
|---|---|---|---|
| 63-256364 | 10/1988 | Japan . | |
| 3104565 | 5/1991 | Japan . | |
| 405285849 | 11/1993 | Japan | 451/540 |
| 1653938 | 6/1991 | U.S.S.R. | 451/540 |

*Primary Examiner*—James G. Smith
*Assistant Examiner*—Dona C. Edwards
*Attorney, Agent, or Firm*—Oblon, Spivak, McClelland, Maier & Neustadt, P.C.

[57] ABSTRACT

The invention relates to a superabrasive grinding wheel comprising very hard abrasive particles and a binder with a metallic matrix, which also contains "pore-forming" adjuvants, notably hollow beads made of ceramic.

This grinding wheel may be used notably for the machining or grinding of glass articles, especially for the grinding of the edges of glass sheets.

16 Claims, No Drawings

SUPER ABRASIVE GRINDING WHEELS

The present invention relates to "superabrasive" grinding wheels. This term is used to designate grinding wheels of very high abrasivity, based on very hard abrasive particles, especially of diamond or of cubic boron nitride, and on a binder which enables these particles to be retained and maintained in place.

This binder may be of three types: it may be a resin, especially a polyimide or phenolic resin. It may also be a vitrified binder in the form of a ceramic matrix of the alumina, alumina-silica or carbide-silica type. The binder may also be based on a metallic matrix, and it is with this third type of binder that the invention is more particularly concerned, because it exhibits a particularly advantageous mechanical strength.

A constant difficulty in the grinding process is proper removal of the dust or other waste products to which the operation gives rise. To do this, a medium, generally water, is conveyed in the direction of the grinding wheel in order to entrain this dust and also, of course, to cool the grinding wheel. However, since the grinding wheel simultaneously attacks a whole portion of the surface of the article being treated, the coolant liquid has difficulty in moving forward towards the whole part being treated. Some accumulation of the waste then takes place. In the case of the treatment of articles made of glass, for example, the grinding is thus systematically accompanied by the formation of a layer of glass paste which tends to oppose the action of the grinding wheel and slows down the grinding operation, making it necessary to perform a number of runs.

The objective of the present invention is an improved type of superabrasive grinding wheels with binder with metal matrix permitting a better management of the problem of the dust and other waste.

The subject of the invention is a superabrasive grinding wheel based on very hard abrasive particles of the diamond or cubic boron nitride type and on a binder with a metallic matrix, and which additionally contains pore-forming elements. Included under this heading are elements the function of which is to create some porosity within the binder of the grinding wheel.

Until now, on the contrary, there has been a tendency rather to employ metallic binders which are as dense as possible, this being in an attempt to slow down the erosion of the grinding wheel as much as possible. However, it has been found, surprisingly, that it is in fact quite advantageous to have a certain porosity "content" in the metallic matrix of the binder, because this porosity very significantly improves the problems of accumulation of waste during the above-mentioned grinding, and even result sin lengthening the lifetime of the grinding wheel.

These pore-forming elements have to be chosen as a function of the process of manufacture of the grinding wheels. In particular, they must be capable of withstanding the pressure and the appropriate temperature. This is the reason why use is preferably made of elements in the form of hollow ceramic beads, especially based on silicon and/or aluminium oxide such as alumina or mullite. Mullite is an aluminium silicate of the $2SiO_2$—$3Al_2O_3$ type. These beads are advantageously chosen with an outer diameter of between 1 micron and 3 mm, especially between 100 microns and 1 mm. Their walls preferably have a thickness of between 2 and 8, especially between 4 and 6 micrometers.

These pore-forming elements are preferably added to the grinding wheel in a proportion of 1 to 80% of the total volume of the grinding wheel, especially between 5 and 50%, or approximately 30% of the said volume.

The way in which these pore-forming elements function is as follows: as the grinding wheel becomes worn, the hollow beads situated at the surface progressively break and the surface of the grinding wheel then becomes pockmarked; the glass paste can then accumulate in these hollows without interfering with the progress of the grinding. In addition, the coolant liquid can move forward continuously at the interface between the grinding wheel and the article being treated and can thus penetrate right through the bottom of these hollows, expel the glass paste—or any other type of dust—which is thus removed in order to be finally returned via the bottom of each hollow formed by a bead.

Furthermore, the coolant liquid thus acts on a much larger area than merely the surface of the rim of the abrasive grinding wheel, permitting a direct cooling to a depth of the order of the diameter of the beads, which correspondingly increases the efficiency of the cooling and, as a result, slows down the wear of the grinding wheel.

It is therefore understandable that it is advantageous for the wall of the hollow beads to be very thin, insofar as this facilitates their breaking, which is what is being primarily sought after in the invention. The bead content of the grinding wheel has to be modified as a function of the type of articles which it will be necessary to grind.

With regard to the metallic matrix of the binder, this can be chosen as a function of the applications for which the grinding wheel is intended. Cobalt is widely employed, and so is bronze, silver—which exhibits the special feature of being relatively ductile, iron or copper.

Different additives, especially such as tungsten carbide, may be added to this matrix in order to increase the erosion resistance of the grinding wheel.

With regard to the abrasive particles of the grinding wheel, these preferably correspond to 5 to 60% of the total volume of the grinding wheel, especially from 10 to 30% of the said volume. They may have a rounded shape or be needle-shaped. Their size is evaluated with the aid of a standardized coding of the European manufacturers of abrasives called the FEPA Code; in this case, a grain size according to this code of between 4 and 1182 is chosen, which corresponds to a particle "mean diameter" of 4 microns to 1.100 mm. A grain size between 40 and 90 is preferably chosen. There again, everything depends on the future use of the grinding wheel, the finest abrasive particles making it possible to obtain the most highly polished surface quality of the workpiece to be ground.

The grinding wheel according to the invention is advantageously employed for machining or grinding glass articles, especially for grinding the edges of glass sheets.

An example of a grinding wheel according to the invention is produced as follows: a grinding wheel is manufactured according to the known methods of manufacture with 15% by volume of diamond particles of 91 grain size and 30% by volume of hollow mullite beads with an outer diameter of approximately 0.5 mm and wall thickness of approximately 5 micrometers, with a cobalt binder. The results are conclusive: grinding of the edges of glass sheets is facilitated by better removal of the waste and better cooling of the grinding wheel, additionally entailing an increase in the lifetime of the grinding wheel of nearly 30% compared with a similar grinding wheel without alumina beads.

I claim:

1. Superabrasive grinding wheel comprising very hard abrasive particles of diamond or cubic boron nitride and a binder with a metallic matrix and pore-forming elements, wherein the pore-forming elements are hollow beads of ceramic, the walls of which have a thickness of between 2 and 8 micrometers, whereby breakage of the walls of the hollow beads and waste removal is facilitated.

2. Grinding wheel according to claim 1, wherein the hollow beads have an outer diameter of between 1 micron and 3 mm.

3. Grinding wheel according to claim 2, wherein the hollow beads have an outer diameter between 100 microns and 1 mm.

4. Grinding wheel according to claim 1, wherein the pore-forming elements are added in a proportion of a volume of 1 to 80% of the total volume of the grinding wheel.

5. Grinding wheel according to claim 4, wherein the pore-forming elements are added in a proportion of a volume of between 5 and 50% of the total volume of the grinding wheel.

6. Grinding wheel according to claim 5, wherein the pore-forming elements are added in a proportion of a volume of approximately 30% of the total volume of the grinding wheel.

7. Grinding wheel according to claim 1, wherein the metallic matrix of the binder is selected from the group consisting of bronze, silver, cobalt, iron, copper and mixtures thereof.

8. Grinding wheel according to claim 1, wherein the binder with metal matrix contains a tungsten carbide additive.

9. Grinding wheel according to claim 1, wherein the abrasive particles correspond to 5 to 60% of the total volume of the grinding wheel.

10. Grinding wheel according to claim 9, wherein the abrasive particles correspond to 10 to 30% of the total volume of the grinding wheel.

11. Grinding wheel according to claim 1, wherein the abrasive particles are rounded in shape or needle-shaped, with a grain size of between 4 and 1182 in FEPA standardized coding.

12. Grinding wheel according to claim 11, wherein the abrasive particles are rounded in shape or needle-shaped, with a grain size of approximately 40 to 90 in FEPA standardized coding.

13. Grinding wheel according to claim 1, wherein said hollow ceramic beads are made of alumina or mullite.

14. Grinding wheel according to claim 1, wherein the hollow beads have a wall thickness between 4 and 6 micrometers.

15. A method of grinding glass articles, comprising grinding a glass article with the grinding wheel of claim 1.

16. The method of claim 15, comprising grinding an edge of a glass sheet.

* * * * *